US009739076B2

(12) United States Patent
Dunn

(10) Patent No.: US 9,739,076 B2
(45) Date of Patent: Aug. 22, 2017

(54) STRAP FOR SECURING A ZIPPER SLIDER

(71) Applicant: Jim Dunn, Peachtree Corners, GA (US)

(72) Inventor: Jim Dunn, Peachtree Corners, GA (US)

( * ) Notice: Subject to any disclaimer, the term of this patent is extended or adjusted under 35 U.S.C. 154(b) by 0 days.

(21) Appl. No.: 14/879,059

(22) Filed: Oct. 8, 2015

(65) Prior Publication Data

US 2016/0113371 A1 Apr. 28, 2016

Related U.S. Application Data

(60) Provisional application No. 62/068,606, filed on Oct. 24, 2014.

(51) Int. Cl.

| | |
|---|---|
| ***E05B 65/52*** | (2006.01) |
| ***A45C 13/18*** | (2006.01) |
| ***A44B 19/30*** | (2006.01) |
| ***E05B 67/00*** | (2006.01) |
| ***A45C 13/10*** | (2006.01) |
| ***A45C 13/20*** | (2006.01) |

(52) U.S. Cl.

CPC ..... *E05B 65/52* (2013.01); *A44B 19/30* (2013.01); *A45C 13/103* (2013.01); *A45C 13/18* (2013.01); *A45C 13/20* (2013.01); *E05B 65/5284* (2013.01); *E05B 67/003* (2013.01)

(58) Field of Classification Search

CPC ..... E05B 37/0031; E05B 37/0034; E05B 37/0068; E05B 65/52; E05B 65/5284; E05B 67/003; E05B 67/006; E05B 73/0005; E05B 73/0011; A44B 19/30; A44B 19/301; A45C 13/18; A45C 13/20

See application file for complete search history.

(56) References Cited

U.S. PATENT DOCUMENTS

| | | | | |
|---|---|---|---|---|
| 3,971,458 | A * | 7/1976 | Koenig | A44B 19/301 190/120 |
| 4,397,378 | A * | 8/1983 | Lee | A45C 3/001 190/119 |
| 4,514,884 | A * | 5/1985 | Kaneko | A44B 19/301 190/120 |
| 6,308,541 | B1 * | 10/2001 | Stowe | A44B 19/301 70/312 |
| 6,401,889 | B1 * | 6/2002 | McCleskey | A45C 13/18 150/129 |
| 8,424,228 | B2 * | 4/2013 | Toussoun | G09F 3/14 24/306 |
| 2005/0035605 | A1 * | 2/2005 | Vanderwater-Piercy | A44B 19/301 292/308 |
| 2006/0006035 | A1 * | 1/2006 | Liang | A45C 13/18 190/101 |
| 2015/0121660 | A1 * | 5/2015 | Li | A44B 99/00 24/302 |

* cited by examiner

*Primary Examiner* — Christopher Boswell

(57) ABSTRACT

The present invention is referred to as a theft prevention strap operable to secure one or more zipper sliders. In embodiments, the strap may include at least two strap ends and a tag end, wherein each strap end includes an opening. A first strap end may be passed underneath a handle of a piece of luggage, a second strap end may be passed over the top of the handle, and a padlock shackle may be passed through both openings and one or more openings associated with one or more zipper sliders. Thereby, the strap may be held in place by the handle, and the zipper sliders may be held in place along a corresponding zipper track such that the zipper sliders cannot be moved along the zipper track to cover up an attempted theft.

20 Claims, 7 Drawing Sheets

STRAP FOR SECURING A ZIPPER SLIDER

CROSS REFERENCE TO RELATED APPLICATION

This application is a non-provisional application claiming the benefit of U.S. Provisional Application Ser. No. 62/068,606, entitled "Strap for Securing a Zipper Slider," which was filed on Oct. 24, 2014, and is incorporated herein by reference in its entirety.

TECHNICAL FIELD

This disclosure relates to a strap operable to restrain movement of a zipper.

BACKGROUND

When traveling, luggage is typically placed and left in positions that leave the luggage vulnerable to theft. Generally, items carried in a piece of luggage are protected only by an enclosure that zips together, and a zipper system can be easily compromised. For example, when the teeth of a zipper system are interlocked, the chain (e.g., interlocking teeth) can be punctured, and the teeth are then easily separated. After separating the zipper teeth, and after the thief removes the valuables from the piece of luggage, the thief can then use the one or more sliders of the zipper system to enmesh the opposing teeth back together. With the zipper teeth enmeshed or interlocked back together, the thief is able to conceal the fact that a zipper system has been compromised.

Previous efforts to secure the zipper system of luggage have not been fully satisfactory and have been ineffective in solving the problem. For example, padlocks have been used to secure a zipper system using two sliders. The shackle of a padlock may be passed through an opening of the pull tab of each slider or through lock "thread holes" associated with the zipper system. When locked, the padlock prevents the sliders from being pulled in opposite directions so that the sliders cannot be used to separate the opposing sets of teeth. However, the interlocked zipper chain can still be punctured (e.g., using a pen, knife or any other pointed or sharp object), and with the pair of sliders having freedom of motion, the sliders can be pulled across the punctured and now open area in the zipper system. As the pair of sliders are pulled across the punctured area, the opening in the zipper system is enmeshed or interlocked back together, and the evidence of the theft is concealed.

Current attempts to prevent and expose luggage theft have been less than ideal. Therefore, a need exists for an apparatus operable to restrict the movement of one or more sliders along a zipper chain.

DETAILED DESCRIPTION

Figure 1:
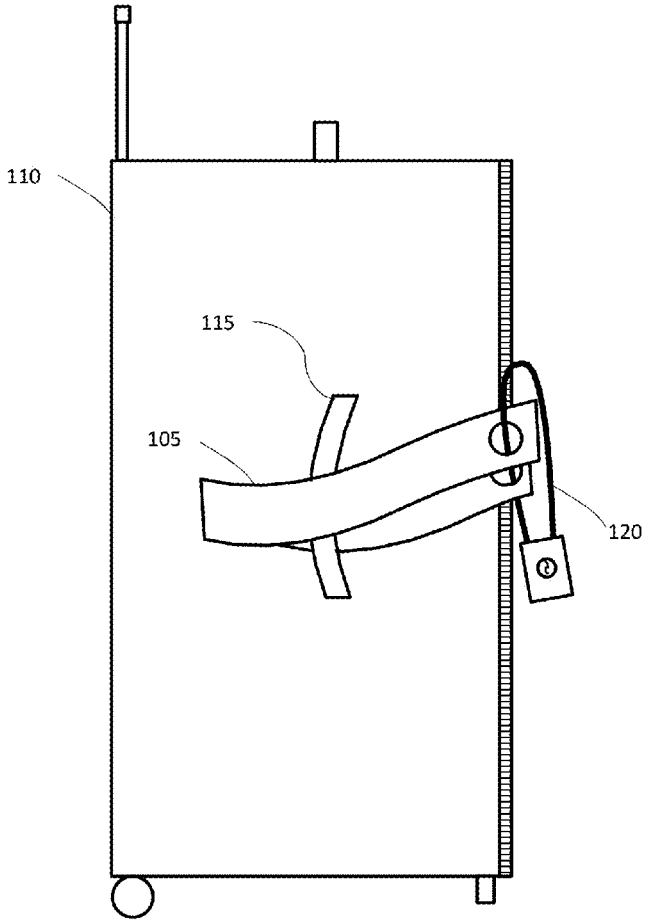
FIG. 1 is a view of a strap system attached to a piece of luggage.

As a preliminary matter, it will be readily understood by those persons skilled in the art that the present invention is susceptible of broad utility and application. Many methods, embodiments, and adaptations of the present invention other than those herein described, as well as many variations, modifications, and equivalent arrangements will be apparent from or reasonably suggested by the present invention and the following description thereof without departing from the substance or scope of the present invention. Accordingly, while the present invention has been described herein in detail in relation to preferred embodiments, it is to be understood that this disclosure is only illustrative and exemplary of the present invention and is made merely for the purpose of providing an enabling disclosure of the invention. The following disclosure is not intended nor is to be construed to limit the present invention or otherwise to exclude any such other embodiments, adaptations, variations, modifications and equivalent arrangements.

Described herein is a strap system operable to restrict the movement of one or more zipper sliders along a zipper chain. The design of the strap system described herein allows the strap system to be wrapped around the handle of a piece of luggage and attached to one or more zipper sliders. Each end of the strap system may include an opening through which a padlock shackle may be passed. The padlock shackle may also be passed through openings in the pull tabs of the sliders so that when the padlock is locked, the sliders are precluded from being pulled in opposite directions. In embodiments, pull tabs of one or more sliders may be passed through the openings at either end of the strap system, and the padlock shackle can then be passed through openings of the pull tabs to prevent the sliders from moving in opposite directions. It should be understood that the strap system may be utilized in conjunction with the padlock and zipper pull tabs in various ways. For example, the padlock shackle may be passed through the zipper tabs and then through openings in the strap system.

In embodiments, the strap system may include one or more concealed compartments. For example, a flexible strip may be permanently affixed at one end to the strap system. The other end of the flexible strip may include a hook-and-loop strip, and the end of the flexible strip may be temporarily affixed to the strap system by mating the hook-and-loop strip on the flexible strip to a corresponding hook-and-loop strip on the strap system. The flexible strip may include a plastic sheath or pouch that is so dimensioned for storing personal items such as identification cards, business cards, money, credit cards, and others.

An embodiment of the invention described herein may include an apparatus comprising: (a) a first elongate strap having an opening at a distal position on the first elongate strap; and (b) a second elongate strap having an opening at a distal position on the second elongate strap, wherein a proximal edge of the second elongate strap is connected to a proximal edge of the first elongate strap, and the second elongate strap is connected to the first elongate strap at a position located between the longitudinal center of the second elongate strap and the proximal edge of the second elongate strap, thereby creating a tag end between the proximal edge of the second elongate strap and the point at which the second elongate strap is connected to the first elongate strap.

According to an embodiment of the invention described herein, the opening at the distal position on the first elongate strap and the opening at the distal position on the second elongate strap each comprises a grommet.

According to an embodiment of the invention described herein, a proximal edge of a third elongate strap is connected to the second elongate strap.

According to an embodiment of the invention described herein, the third elongate strap comprises a compartment positioned on the surface of the third elongate strap that faces the second elongate strap.

According to an embodiment of the invention described herein, the third elongate strap comprises a first temporary connector element positioned on the surface of the third elongate strap that faces the second elongate strap, and the second elongate strap comprises a second temporary connector element positioned on the surface of the second elongate strap that faces the third elongate strap, the second temporary connector element being operable to mate with the first temporary connector element.

According to an embodiment of the invention described herein, one of the first temporary connector element and the second temporary connector element comprises hook fabric of a hook-and-loop fastener system and the other of the first temporary connector element and the second temporary connector element comprises loop fabric of a hook-and-loop fastener system.

According to an embodiment of the invention described herein, the third elongate strap comprises a pull tab positioned at the distal end of the third elongate strap.

According to an embodiment of the invention described herein, the inner face of the first elongate strap and the inner face of the second elongate strap comprise a sticky surface.

According to an embodiment of the invention described herein, the tag end is permanently attached to a piece of luggage.

According to an embodiment of the invention described herein, the tag comprises one or more pins operable to be affixed to the surface of a piece of luggage.

An embodiment of the invention described herein may include a method for making a zipper lock strap system, wherein the method comprises: (a) folding a first elongate strap over itself in half thereby creating a first strap segment and a second strap segment; (b) permanently affixing the interior surface of the first strap segment to the interior surface of the second strap segment along a lateral line at the proximal ends of the strap segments; (c) permanently affixing the interior surface of the first strap segment to the interior surface of the second strap segment along a lateral line at a position located between the center and the proximal edges of the strap segments such that a tag end is created where the interior surfaces of the strap segments are held together and the distal portions of the first and second strap segments are not attached to each other; and (d) creating a first opening near the distal end of the first strap segment and a second opening near the distal end of the second strap segment, wherein the first opening and the second opening are: (i) dimensioned such that a shackle associated with a locking mechanism may be passed through the openings; and (ii) positioned on each respective strap segment such that the openings are aligned when the distal portions of each strap segment are placed flat against each other.

According to an embodiment of the invention described herein, a grommet is inserted at each of the first opening and the second opening.

According to an embodiment of the invention described herein, a second elongate strap is affixed to one of the strap segments, wherein the proximal edge of the second elongate strap is attached to the exterior surface of the strap segment such that the interior surface of the second elongate strap faces the exterior surface of the strap segment.

According to an embodiment of the invention described herein, the second elongate strap comprises a compartment positioned on the interior surface of the second elongate strap.

According to an embodiment of the invention described herein, the interior surfaces of the first strap segment and the second strap segment are covered with a sticky material.

An embodiment of the invention described herein may include an apparatus comprising: (a) a first elongate strap having an opening at a distal position on the first elongate strap; (b) a second elongate strap comprising a locking mechanism located at the distal edge of the second elongate strap; and (c) wherein a proximal edge of the second elongate strap is connected to a proximal edge of the first elongate strap, and the second elongate strap is connected to the first elongate strap at a position located between the longitudinal center of the second elongate strap and the proximal edge of the second elongate strap, thereby creating a tag end between the proximal edge of the second elongate strap and the point at which the second elongate strap is connected to the first elongate strap.

According to an embodiment of the invention described herein, the locking mechanism comprises a padlock, the padlock comprising a flexible cable shackle so dimensioned as to be passed through openings associated with two or more zipper sliders and the opening associated with the first elongate strap.

According to an embodiment of the invention described herein, the locking mechanism comprises a padlock, the padlock comprising a combination lock having a plurality of dials.

According to an embodiment of the invention described herein, the locking mechanism comprises a port for a Transportation Security Administration (TSA) bypass key.

FIG. 1 is a view of a strap system 105 attached to a piece of luggage 110. In embodiments, the strap system 105 may be wrapped around a handle 115 of a piece of luggage 110. A padlock shackle 120 may be passed through openings of one or more pull tabs of zipper sliders and through an opening at each end of the strap system 105. With the strap system 105 secured around the handle 115 of the piece of luggage 110 and the one or more zipper sliders secured to the strap system 105, the movement of the zipper sliders along the zipper chain is restricted. In embodiments, the one or more pull tabs of zipper sliders may be passed through the openings at both ends of the strap system 105, and a padlock shackle 120 can then be passed through openings of the pull tabs. It should be understood that the strap system 105 may be utilized in conjunction with the padlock and zipper pull tabs in various ways. For example, the padlock shackle may be passed through the zipper tabs and then through openings in the strap system 105.

In embodiments, each zipper slider may include an interlocking eyelet, wherein the eyelets align with each other when the zipper sliders are pulled adjacent to one another. The padlock shackle may be passed through each of the openings in the strap system and then through each eyelet of the zipper sliders before being locked into place in a corresponding locking mechanism.

Figure 2:
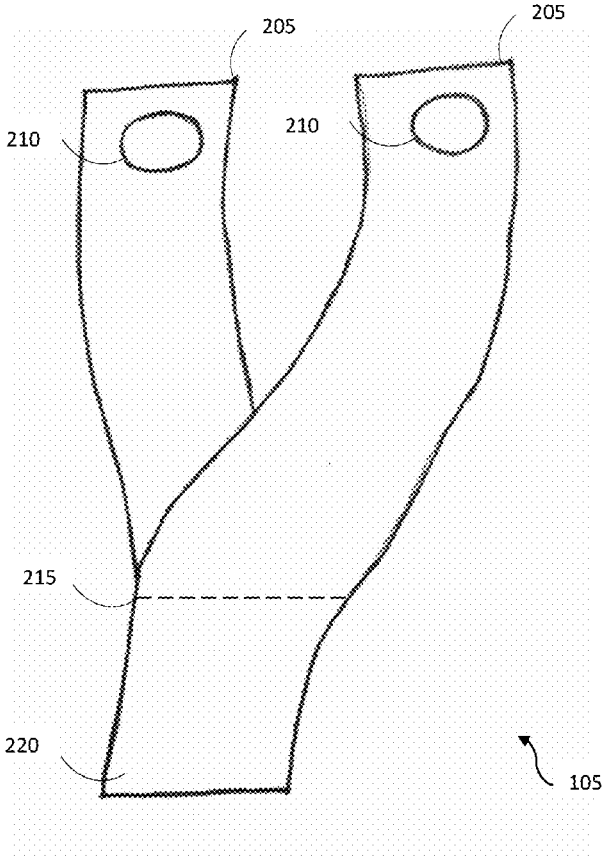
FIG. 2 is a view of a strap system.

FIG. 2 is a view of a strap system 105. In embodiments, the strap system 105 may comprise two straps 205 of flexible material. For example, the strap system 105 may include a first elongate strap 205 and a second elongate strap 205. The two straps 205 may be attached to each other at one end (e.g., the proximal end of the straps as shown in FIG. 2). In embodiments, the two straps may be attached to each other at a position located between the longitudinal center of the second elongate strap and the proximal edge of the second elongate strap (e.g., position 215), thereby creating a tag end (e.g., tag 220) between the proximal edge of the second elongate strap and the point at which the second elongate strap is connected to the first elongate strap.

In embodiments, a single strap may be folded in half over itself to create the two straps 205. Two or more points along the length of each strap 205 may be permanently affixed to each other. For example, lateral stitching at a first proximal location near the proximal edges of the straps 205 (e.g., near the center of the single strap) and lateral stitching at a point between the proximal edges of the straps 205 and the center point of the straps 205 may keep the proximal sides of the straps 205 together while allowing the distal ends of the straps 205 to remain separated from each other. The connected proximal sides of the straps 205 may create a tag end (e.g., tag 220).

At another end, each strap may include an opening 210. The opening 210 may be a grommet. It should be understood that that each strap 205 may be made of various flexible materials (e.g., polymer) and may be of various lengths. In embodiments, the distance between the point of attachment (e.g., position 215) between the two straps 205 and the end of each strap comprising the opening 210 may be so dimensioned as to allow the strap system 105 to extend from a handle of a piece of luggage to a zipper chain of the piece of luggage. For example, the strap system 105 may be so dimensioned such that the distance between the point of attachment 215 and an opening 210 is equivalent to or close to the distance between a handle of a piece of luggage and a zipper track of the piece of luggage. When so dimensioned, a first strap 205 may be fed underneath the handle, the second strap 205 may be laid over the top of the handle, and a padlock shackle 120 may be passed through each of the openings 210 and one of more openings associated with one or more zipper sliders (e.g., eyelets) such that the strap system is held in place by the static position of the handle.

In embodiments, one or both of the two strips 205 may be reinforced with a wire or mesh reinforcement layer. For example, one or both of the two strips 205 may be embedded with a wire, mesh, or other rigid material to protect the strips from being easily cut through.

In embodiments, the interior surfaces of the two straps 205 may include a sticky or adhering covering such as a rubber or synthetic material. It should be understood that the rubber or synthetic material may partially or may completely cover the interior surfaces of the two straps 205. The sticky or adhering interior surfaces may provide a better grip to a handle of a piece of luggage.

Figure 3:
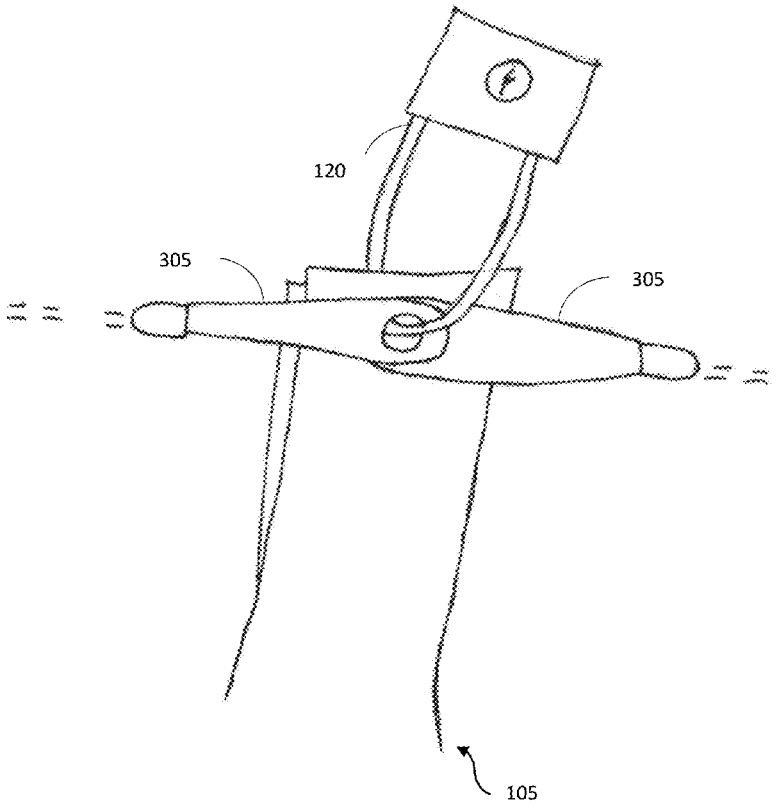
FIG. 3 is a view of a strap system, slider pull tabs, and a padlock in an interlocking position.

FIG. 3 is a view of a strap system 105, slider pull tabs 305, and a padlock shackle 120 in an interlocking position. In embodiments, a padlock shackle 120 may be passed through the openings of a strap system 105 and through the openings of zipper pull tabs 305 (or eyelets located on the zipper sliders). It should be understood that the radius of each opening in the strap system 105 may be dimensioned so as to pass padlock shackles 120 and/or zipper pull tabs 305 of various sizes through the strap system openings. It should further be understood that the shape of the openings of the strap system 105 may vary to accommodate different size zipper slider pull tabs 305 and padlock shackles 120. The openings of a zipper slider through which the padlock shackle 120 may be passed can also include one or more eyelets located at any of a variety of locations on the zipper slider.

Figure 4:
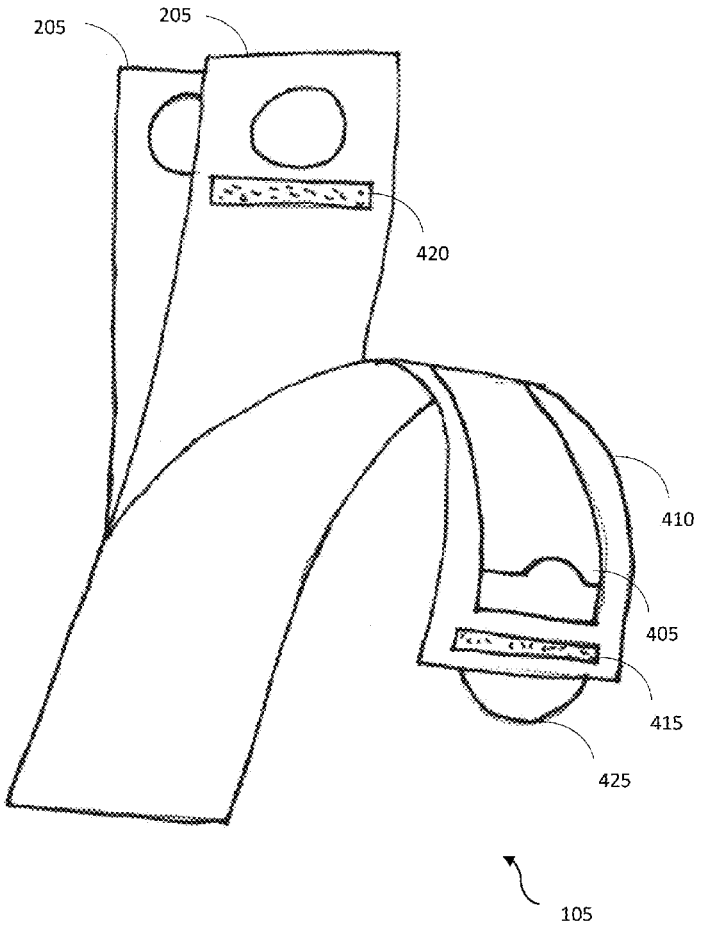
FIG. 4 is a view of a strap system having a concealed compartment.

FIG. 4 is a view of a strap system 105 having a concealed compartment 405. In embodiments, a third strap 410 of flexible material may be attached to the other two straps 205 of flexible material. The third strap 410 of flexible material may be affixed to the other two straps 205 at one end. In embodiments, so that a free end of the third strap 410 may be temporarily attached to one of the other straps 205, the third strap 410 may include a hook-and-loop fastening strip 415 (e.g., a temporary connector element) at one end, and a corresponding hook-and-loop fastening strip 420 (e.g., corresponding temporary connector element) may be affixed to one of the other straps 205. The third strap 410 may also include a tab 425 at one end to allow the third strap 410 to be pulled away from the other straps 205.

In embodiments, the third strap 410 may include a compartment 405. The compartment 405 may be a sheath or pouch. It should be understood that the compartment 405 may vary in size according to the length and width of the third strap 410 and the intended function of the compartment 405. For example, the compartment 405 may be used to store a variety of personal items such as identification cards, business cards, credit cards, tracking devices, or any other item. The compartment 405 may be made of various materials. For example, the compartment 405 may be made from a transparent plastic. In embodiments, a tracking device may be embedded within one of the two straps 205, within the third strap 410, or within the compartment 405.

Figure 5:
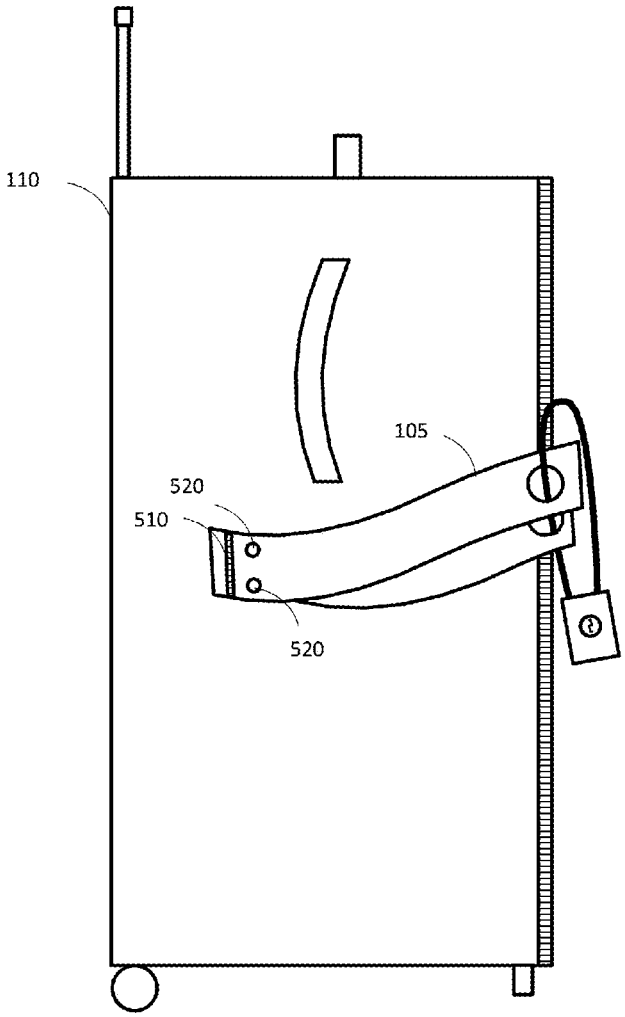
FIG. 5 is a view of a strap system that may be permanently or temporarily affixed to a piece of luggage.

FIG. 5 is a view of a strap system 105 that may be permanently or temporarily affixed to a piece of luggage. In embodiments, the strap system 105 may be positioned at any point along the outside of a piece of luggage 110 so that the openings (e.g., openings 210 of FIG. 2) may be located over a zipper track of the piece of luggage. The strap system 105 may be permanently affixed to the piece of luggage 110. For example, a proximal end 510 of the strap system may be sewn into the piece of luggage 110. In an alternate embodiment, the strap system 105 may be temporarily affixed to the piece of luggage 110. For example, one or more buttons or pins 520 may be attached to the tag end (e.g., tag 220 of FIG. 2) of the strap system 105 such that the buttons or pins 520 attach the tag end of the strap system 105 to one or more points along the outside of the piece of luggage 110. It will be appreciated that with the strap system 105 permanently or temporarily affixed to the outer surface of the piece of luggage via one of these methods, the straps (e.g., straps 205 of FIG. 2) do not have to be wrapped around a handle in order to hold the strap system 105 in place.

Figure 6:
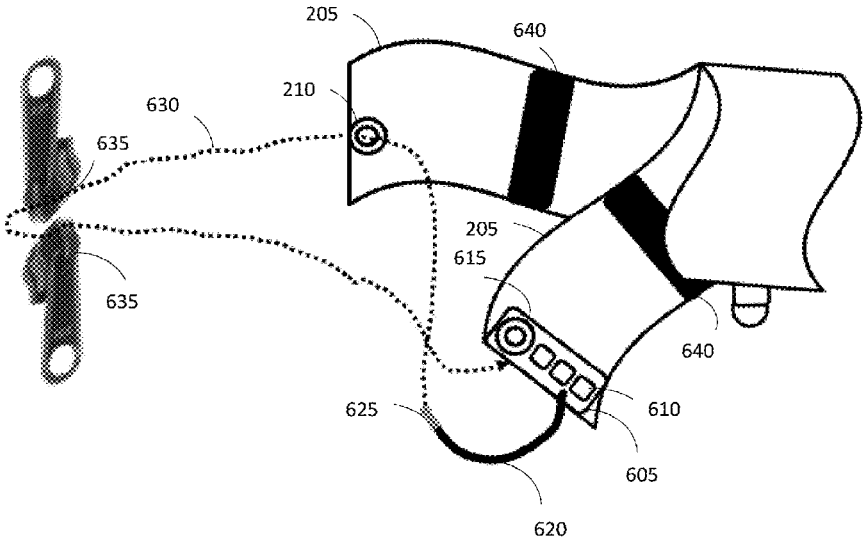
FIG. 6 is a view of a zipper lock strap system including a locking mechanism.

FIG. 6 is a view of a zipper lock strap system including a locking mechanism 605. In embodiments, the locking mechanism 605 may be positioned at the distal end of a strap 205, and may include one or more dials 610, a key port 615, and a shackle 620. As an example, each of the one or more dials 610 may include a plurality of alphabetical or numerical symbols, and the dials 610 may provide the user with a mechanism to input a combination for unlocking the locking mechanism 605. It will be appreciated that combination locks are well known in the art. It should be understood that the locking mechanism 605 may include various other types of combination locks and key locks.

In embodiments, the key port 615 may provide a user with a mechanism for unlocking the locking mechanism 605. The key port 615 may be a port for a Transportation Security Administration (TSA) bypass key.

In embodiments, a shackle 620 may be permanently affixed at one end to the locking mechanism 605, and the other end of the shackle 620 may include seizing hardware 625 that may lock the end of the shackle 620 into place when inserted into an opening of the locking mechanism 605 and the locking mechanism 605 is engaged. The shackle 620 may be a flexible or semi-flexible cable (e.g., TSA approved lock cable). When the locking mechanism 605 is disengaged, the seizing hardware 625 may be passed through an opening 210 of the other strap 205 and one or more zipper pull tab eyelets 635 before being inserted into an opening of the locking mechanism 605. Once inserted into the opening of the locking mechanism 605, the seizing hardware 625 may be held into place when the locking mechanism is engaged (e.g., by rotating one or more of the dials 610). For example, the seizing hardware 625 may be passed through various components along the locking path 630.

In embodiments, the straps 205 may be permanently connected to each other at a proximal end, and may be temporarily affixed to each other at a central location. For example, corresponding hook-and-loop strips 640 may be attached at a central location of each of the straps 205, and the hook-and-loop strips 640 may hold the straps 205 together. When one of the straps 205 is passed underneath a handle, of a piece of luggage, for example, the hook-and-loop strips 640 may be mated together forming a tag end between the center and proximal ends of the straps 205.

Figure 7:
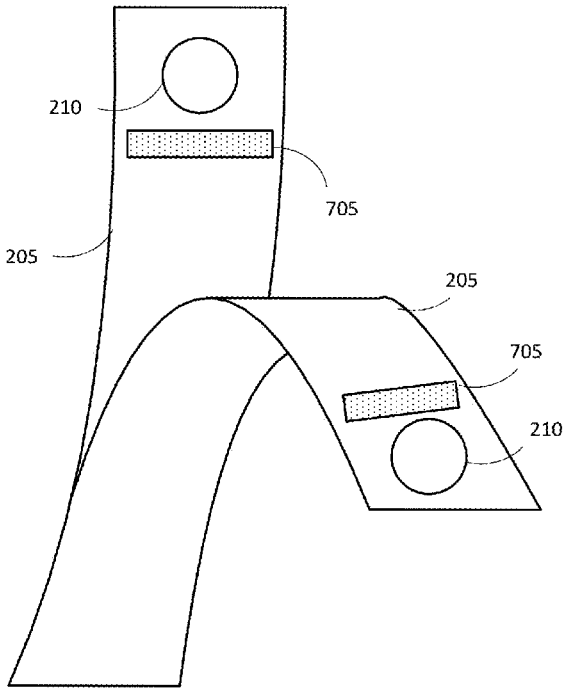
FIG. 7 is a view of a zipper lock strap system including a secondary attachment mechanism Like reference numbers and designations in the various drawings indicate like elements.

FIG. 7 is a view of a zipper lock strap system including a secondary attachment mechanism 705. In embodiments, the secondary attachment mechanism may provide a means for temporarily attaching two secondary points of the straps 205. The secondary attachment point may be towards the distal end of each strap 205 (e.g., the end of each strap 205 that is closest to the corresponding opening 210). For example, the secondary attachment mechanism 705 may include hook-and-loop fasteners, wherein each secondary attachment mechanism 705 is a hook-and-loop component that mates with the other secondary attachment mechanism 705. When the strap system 105 is placed around the handle of a piece of luggage, the strap system 105 may be securely held around the handle while the straps 205 are temporarily attached at the secondary attachment point via the secondary attachment mechanism 705. The secondary attachment mechanism 705 can hold the strap system 105 in place even when a locking mechanism is removed from the openings 210.

It should be understood that the dimensions of the strap system 105 and components of the strap system 105 may be configured such that the strap may be wrapped around a handle of a piece of luggage and interlock with one or more zipper slider pull tabs. The drawings provided herein are only intended to provide examples of sizes, shapes, and configurations of the strap system and its components.

It should be further understood that the strap system 105 may be used in conjunction with various types of padlocks and various types of zipper locks having various sizes and types of pull tab openings or padlock shackle thread holes.

What is claimed is:

1. An apparatus comprising:

a first elongate strap having an opening at a distal position on the first elongate strap;

a second elongate strap having an opening at a distal position on the second elongate strap, wherein a proximal edge of the second elongate strap is connected to a proximal edge of the first elongate strap, and the second elongate strap is connected to the first elongate strap at a position located between the longitudinal center of the second elongate strap and the proximal edge of the second elongate strap, thereby creating a tag end between the proximal edge of the second elongate strap and the point at which the second elongate strap is connected to the first elongate strap; and a flexible padlock shackle that passes through the opening at the distal position on the first elongate strap, the opening at the distal position on the second elongate strap, an eyelet of a first zipper slider, and an eyelet of a second zipper slider.

2. The apparatus of claim 1, wherein the opening at the distal position on the first elongate strap and the opening at the distal position on the second elongate strap each comprises a grommet.

3. The apparatus of claim 1, further comprising a third elongate strap, wherein a proximal edge of the third elongate strap is connected to the second elongate strap.

4. The apparatus of claim 3, wherein the third elongate strap comprises a compartment positioned on the surface of the third elongate strap that faces the second elongate strap.

5. The apparatus of claim 3, wherein the third elongate strap comprises a pull tab positioned at the distal end of the third elongate strap.

6. The apparatus of claim 3, wherein:

the third elongate strap comprises a first temporary connector element positioned on the surface of the third elongate strap that faces the second elongate strap; and the second elongate strap comprises a second temporary connector element positioned on the surface of the second elongate strap that faces the third elongate strap, the second temporary connector element being operable to mate with the first temporary connector element.

7. The apparatus of claim 6, wherein one of the first temporary connector element and the second temporary connector element comprises hook fabric of a hook-and-loop fastener system and the other of the first temporary connector element and the second temporary connector element comprises loop fabric of a hook-and-loop fastener system.

8. The apparatus of claim of claim 1, wherein the inner face of the first elongate strap and the inner face of the second elongate strap comprise a sticky surface.

9. The apparatus of claim 1, wherein the tag end is permanently attached to a piece of luggage.

10. The apparatus of claim 1, wherein the tag comprises one or more pins operable to be affixed to the surface of a piece of luggage.

11. A method for making a zipper lock strap system, wherein the method comprises:

folding a first elongate strap over itself in half thereby creating a first strap segment and a second strap segment;

permanently affixing the interior surface of the first strap segment to the interior surface of the second strap segment along a lateral line at the proximal ends of the strap segments;

permanently affixing the interior surface of the first strap segment to the interior surface of the second strap segment along a lateral line at a position located between the center and the proximal edges of the strap segments such that a tag end is created where the interior surfaces of the strap segments are held together and the distal portions of the first and second strap segments are not attached to each other;

creating a first opening near the distal end of the first strap segment and a second opening near the distal end of the second strap segment, wherein the first opening and the second opening are:

dimensioned such that a shackle associated with a locking mechanism may be passed through the openings, an eyelet of a first zipper slider, and an eyelet of a second zipper slider; and positioned on each respective strap segment such that the openings are aligned when the distal portions of each strap segment are placed flat against each other.

12. The method of claim 11, further comprising:

inserting a grommet at each of the first opening and the second opening.

13. The method of claim 11, further comprising:

affixing a second elongate strap to one of the strap segments, wherein the proximal edge of the second elongate strap is attached to the exterior surface of the strap segment such that the interior surface of the second elongate strap faces the exterior surface of the strap segment.

14. The method of claim 13, wherein the second elongate strap comprises a compartment positioned on the interior surface of the second elongate strap.

15. The method of claim 11, further comprising:

covering the interior surfaces of the first strap segment and the second strap segment with a sticky material.

16. An apparatus comprising:

a first elongate strap having an opening at a distal position on the first elongate strap;

a second elongate strap comprising a locking mechanism located at the distal edge of the second elongate strap;

wherein a proximal edge of the second elongate strap is connected to a proximal edge of the first elongate strap, and the second elongate strap is connected to the first elongate strap at a position located between the longitudinal center of the second elongate strap and the proximal edge of the second elongate strap, thereby creating a tag end between the proximal edge of the second elongate strap and the point at which the second elongate strap is connected to the first elongate strap; and wherein the locking mechanism comprises a flexible padlock shackle that passes through the opening at the distal position on the first elongate strap, an eyelet of a first zipper slider, and an eyelet of a second zipper slider.

17. The apparatus of claim 16, wherein the locking mechanism comprises a padlock, the padlock comprising:

a flexible cable shackle so dimensioned as to be passed through openings associated with two or more zipper sliders and the opening associated with the first elongate strap.

18. The apparatus of claim 16, wherein the locking mechanism comprises a padlock, the padlock comprising a combination lock having a plurality of dials.

19. The apparatus of claim 16, wherein the locking mechanism comprises a port for a Transportation Security Administration (TSA) bypass key.

20. The apparatus of claim 16, further comprising a third elongate strap, wherein a proximal edge of the third elongate strap is connected to the second elongate strap.

* * * * *